United States Patent [19]

Foerster

[11] 4,223,423

[45] Sep. 23, 1980

[54] COTTON LINT CLEANER

[76] Inventor: John E. Foerster, Route 1, Box 70, Lubbock, Tex. 79401

[21] Appl. No.: 905,551

[22] Filed: May 12, 1978

Related U.S. Application Data

[62] Division of Ser. No. 665,099, Mar. 8, 1976, Pat. No. 4,102,017.

[51] Int. Cl.[2] ..... D01B 1/00

[52] U.S. Cl. ..... 19/203; 19/303

[58] Field of Search ..... 19/88, 89, 202, 203, 19/204, 205, 304, 307, 308, 306, 300, 64.5, 97.5, 303

[56] References Cited

U.S. PATENT DOCUMENTS

| | | | |
|---|---|---|---|
| 476,710 | 6/1892 | Wherry et al. | 19/304 X |
| 561,689 | 6/1896 | Patterson | 19/304 |
| 562,338 | 6/1896 | Patterson | 19/303 |
| 1,953,245 | 4/1934 | MacKenzie | 19/205 |
| 2,152,901 | 4/1939 | Manning | 19/307 X |
| 2,269,085 | 1/1942 | Morgan | 19/202 X |
| 2,703,441 | 3/1955 | Langdon et al. | 19/89 X |
| 2,704,862 | 3/1955 | Moss | 19/202 |
| 2,830,328 | 4/1958 | Day | 19/203 |
| 2,876,500 | 3/1959 | Buresch et al. | 19/89 |
| 2,948,022 | 8/1960 | Day | 19/203 |
| 3,388,434 | 6/1968 | Calhoun | 19/203 |
| 3,425,097 | 2/1969 | Rood et al. | 19/203 |
| 3,748,693 | 7/1973 | Vespersen | 19/306 X |

*Primary Examiner*—Louis Rimrodt

*Attorney, Agent, or Firm*—Clarence A. O'Brien; Harvey B. Jacobson

[57] ABSTRACT

A cotton lint cleaner having a number of new and unique features. The lint cleaner uses a common air stream laden with cotton to be cleaned through a moving screen and then through feed rollers to a cylindrical saw, where a centrifugal air flow doffing impeller doffs the cleaned cotton from said saw, for discharge from the device. Special spring biased feed bars are also a part of this invention. Additional features include special grid bars, special settling and collection chambers, guide vane structure, a rotating paddle wheel vacuum lock, an adjustable vacuum valve control, and filtering and discharging of the exhaust air flow through a cover over the operating drive for the over-all machine in order to exclude contamination from the outside air of said drive components. Special tension mountings for the grid bars are also disclosed.

4 Claims, 15 Drawing Figures

Fig. 3
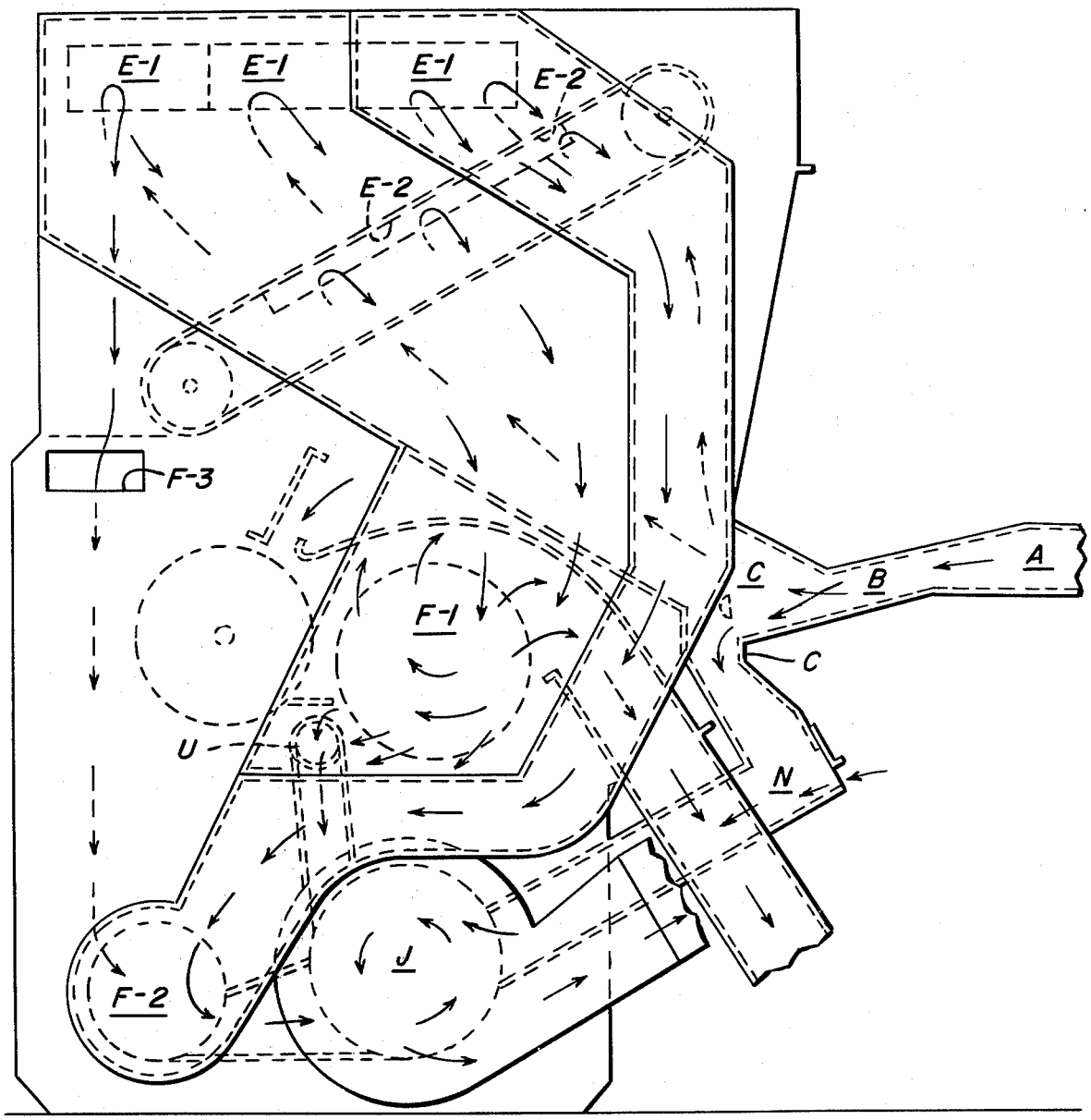
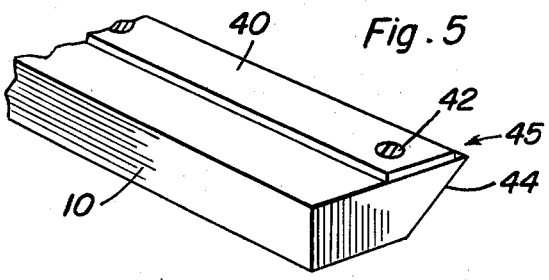
Fig. 5
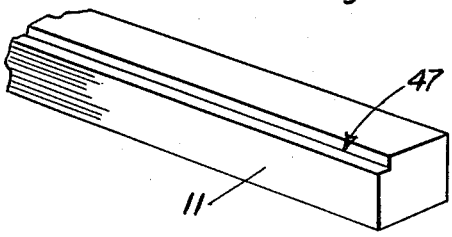
Fig. 6

Unclean Cotton In
Clean Cotton Out
152
150
155
B
C
O
H
H'
N
G
212
420'
422'
112
114
116
126
122
128
420
422
J
I
V
260
7
8
9
10
11
270
F-3
410
400
137
135
113
140
131
W
144
142
133
T
F-2
M

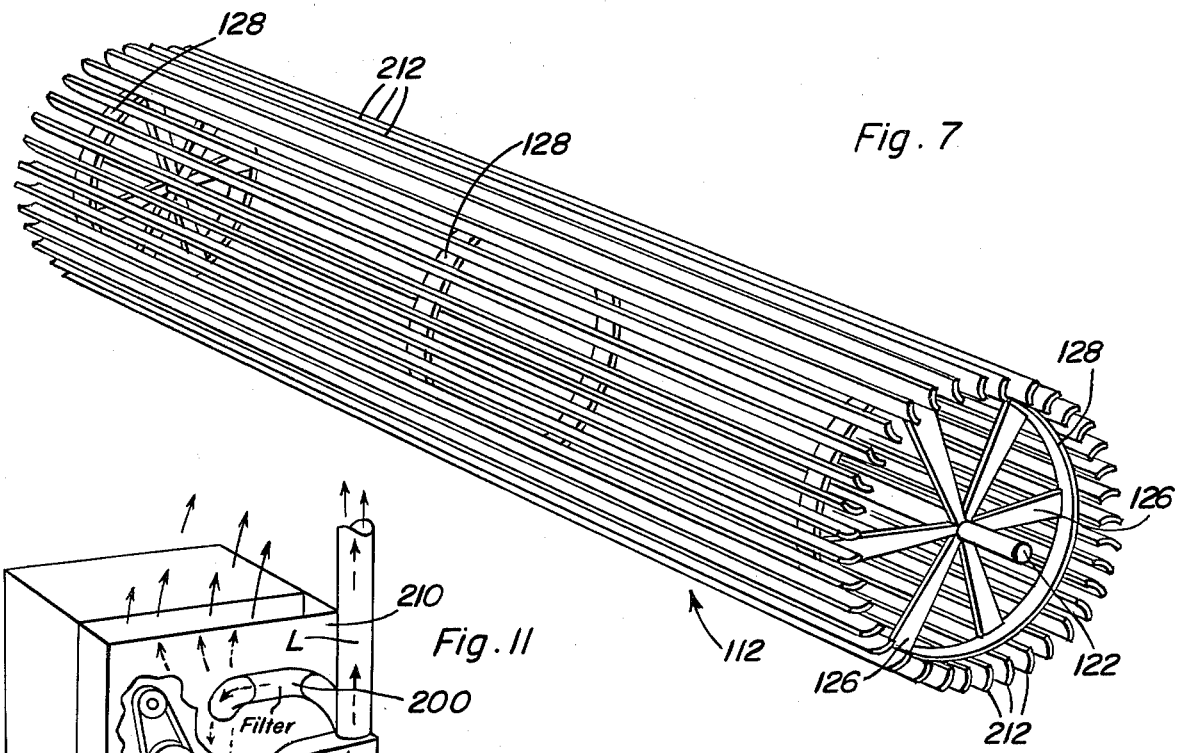
Fig. 7
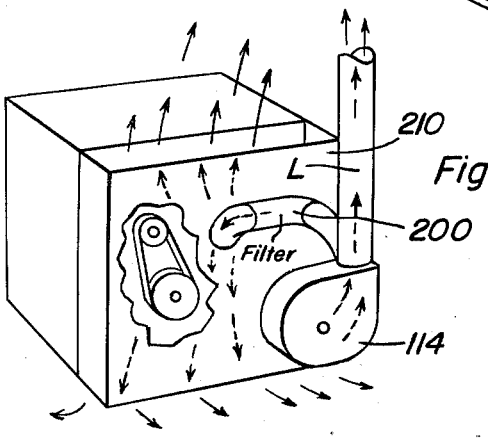
Fig. 11
Fig. 8
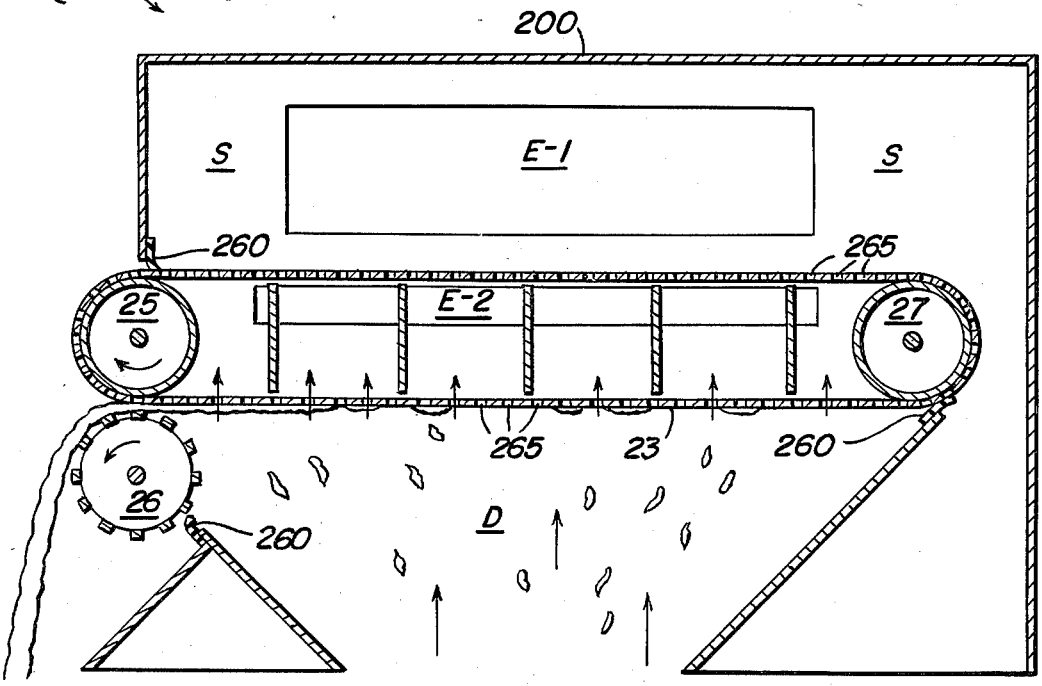

COTTON LINT CLEANER

This is a division of application Ser. No. 665,099, filed Mar. 8, 1976 now U.S. Pat. No. 4,102,017, issued July 25, 1978.

BACKGROUND OF THE INVENTION

1. Field of the Invention

This invention relates to a cotton lint cleaner for use with cotton gins in order to improve the quality of the cotton being processed thereby.

2. Description of the Prior Art

A common problem with known cotton cleaning apparatus is that the commonly used cylindrical condensers tend to retain collected cotton thereon which is intended to be removed by a wiping action of associated rollers, but often times the cotton will remain on the cylinder and return to the initial starting point.

Another problem with known cotton cleaners is that the doffing apparatus associated with the saws and grid bar structure will tend to jam up and create a fire hazard.

Another common problem is that with doffing mechanisms utilizing brushes and the like, often times the brushes themselves will burn once a fire has been started in the device, with a consequent complete rendering of the doffing mechanism useless.

Another known problem is that when cotton slips by the conventional-type condensers and doffers, contaminated and unwanted particles will be discharged out the exhaust of the apparatus.

Known prior art patents which may be pertinent to this invention are as follows:

G. C. Morgan; U.S. Pat. No. 2,269,085; Jan. 6, 1942

E. E. Moss; U.S. Pat. No. 2,704,862; Mar. 29, 1955

D. D. Day; U.S. Pat. No. 2,948,022; Aug. 9, 1960

W. L. Calhoun, Jr.; U.S. Pat. No. 3,388,434; June 18, 1968

W. E. Rood, Jr. et al; U.S. Pat. No. 3,425,097; Feb. 4, 1969

None of these known prior art devices offers the new and unique features of the invention disclosed herein.

SUMMARY OF THE INVENTION

An object of the present invention is to provide a cotton lint cleaner having a number of new and unique features incorporated therein. One of the objects is to use the same air stream throughout the entire apparatus to induce cotton into the lint cleaner for processing of said cotton, and to remove refuse therefrom, to collect cotton flowing in said air stream by a belt-type condenser, to feed the cotton being processed through feed rollers to saws for doffing by a centrifugal impeller doffer, to discharge the clean cotton and to bathe the machine drives in a protective air current.

Another object of the present invention is to use pressure or vacuum through a moving screen or porous belt to condense or accumulate fibers being processed on said belt and then to convey said collected fibers into another pressure area.

Another object is to use sudden pressure differential or the blocking of air flow in order to allow material fiber being carried by said air flow to flow away from a condenser screen belt.

A still further object of this invention is a centrifugal impeller with a plurality of shallow blades or vanes for the purpose of doffing cotton or fibrous material from a saw cylinder. This centrifugal impeller creates an air flow from the center thereof and outwardly through the vanes directly upon the saw cylinder thereby increasing the desired doffing.

A still further object of this invention is a cotton lint cleaner feed mechanism having two splined feed rollers together with a pivotally mounted feed bar associated with a saw cylinder in order to permit moving away of said feed bar in the event of an extremely large bat of cotton or fiber, lump, or foreign object passing through the aforementioned structure. This is for the overall purpose of preventing choking of the saw.

An additional further object is to provide various means for creating pressure on the pivotable arm supporting said previously mentioned feed bar.

A still further additional object of this invention is to provide specially shaped grid bars for use with the saw of the cotton cleaning unit. These provide two cleaning edges per bar and requires the fiber to make two small bends instead of one severe bend. This lessens fiber damage due to kinking and cutting caused by the sharp bending of fiber around the single edge of a conventional type grid bar.

An additional further object is in the settling chambers employed with the cotton lint cleaner of this invention. The purpose being to allow the contamination particles to settle out in said chambers and allow the clean cotton to pass on through the apparatus.

An additional still further object of this invention is in the use of special guide vanes to control air flow through various portions of the cotton cleaner apparatus. Control of air flow through the machine is extremely important, and the use of these special vanes enables said air flow to be properly directed and controlled.

Another object of this invention is in the use of a rotating paddle wheel control air flow from one stage of said machine to another to form a vacuum lock and also to agitate refuse accumulating in one of the refuse chambers.

Another further object is in the removing of cotton lint fibers from the refuse chamber by an adjustable vacuum valve to control the amount of lint being reunited with lint from the doffer mechanism.

An additional still further object is to filter the air being exhausted from said device and after said filtering to divert a portion of said air through a loose fitting cover around the outer perimeter of the machine so as to protect the drive elements of the machine.

Another additional object is in the use of tension mounting or stretching of the grid bars adjacent the saw surface in order to reduce vibration of said grid bars and to allow a more adequate adjustment of said grid bars in relation to said saw.

Another object of this invention is in the ducting of pepper trash from the condenser to a refuse fan for collection and removal from the apparatus.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a side elevational view of the flow paths of the air through the apparatus of this invention.

FIG. 5 is a perspective view, of part of, one form of grid bar used with the apparatus of this invention.

FIG. 6 is a perspective view, of part of, another embodiment of the grid bar used with the apparatus of this invention.

FIG. 7 is a perspective view of the air vane doffing mechanism as used with the apparatus of this invention.

FIG. 8 is a side, cross-sectional view, of the belt condenser as used with the apparatus of this invention.

FIG. 11 is a perspective view, partly broken away, of the pressurized filtered exhaust flow through the drive component cover.

DESCRIPTION OF THE PREFERRED EMBODIMENT

Figure 1:
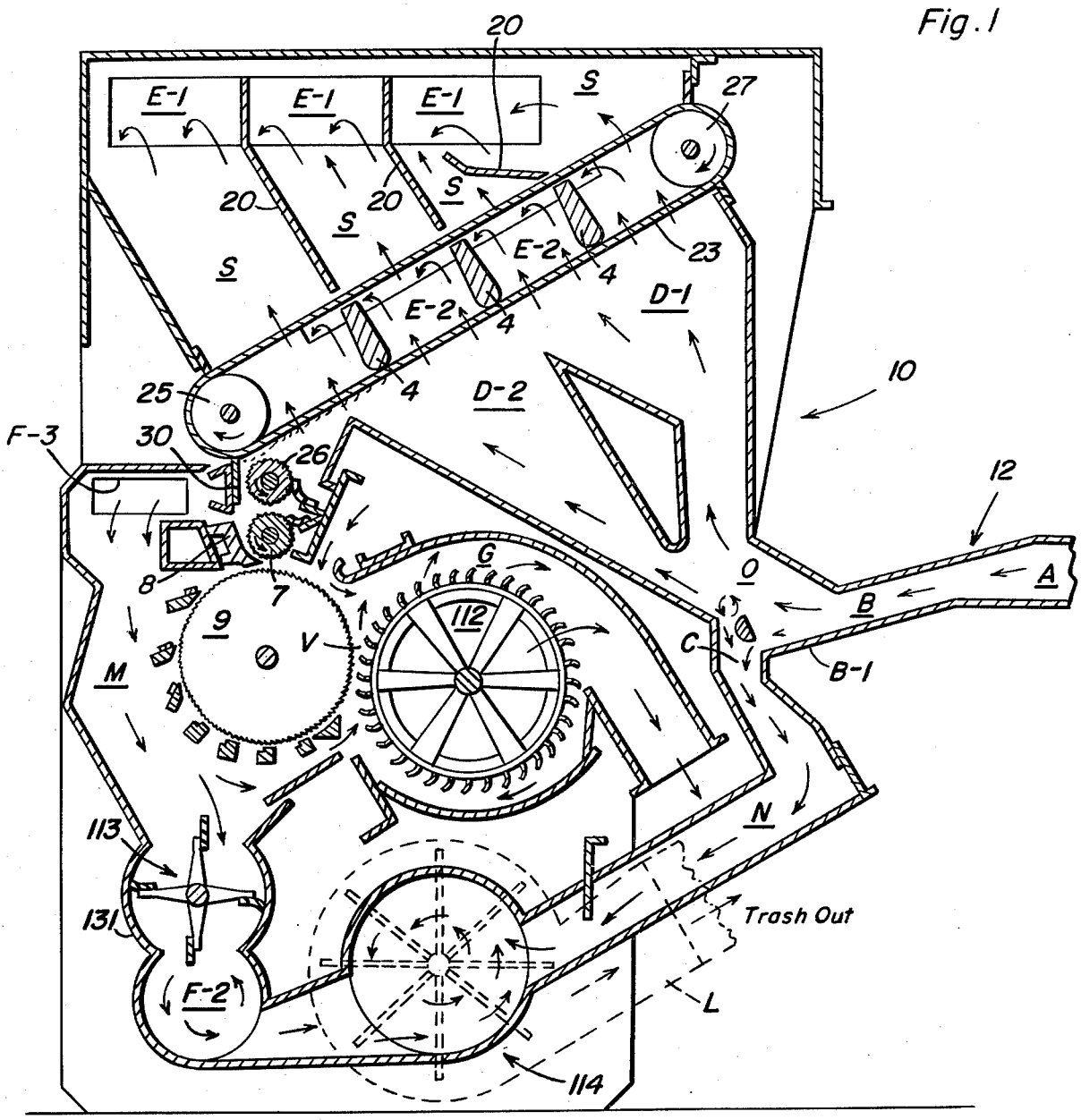
FIG. 1 is a cross-sectional, side elevation of the overall machine of this invention.

According to FIG. 1 of the drawings, reference numeral 10 indicates the apparatus for cleaning cotton as described herein. Reference numeral 12 indicates the input duct for this apparatus.

In order for an easier understanding of the overall operation of the apparatus of this invention, the entire operation will be described in general with reference to the figures of the drawings before the individual and special components thereof are described in detail. Looking primarily at FIGS. 1, 4*a* and 4*b*, cotton to be cleaned is vacuumed or blown into the duct 12 along flow path A with 72–100% (depending on the value setting) of the air flowing into the lint cleaner. This air flow moves the dirty cotton to duct B which is smaller in cross-section than duct A, thereby accelerating same. This flow causes the heavier particles of seed, stick, leaf particles, and dirt to accumulate in the lower portions of said duct indicated by reference B-1, and continues in a straight line flow into the "still air region" (relatively little air movement) in the lower part of chamber O and hopper C. This "still air region" is present due to the drastic enlargement of cross-sectional area from duct B to chamber O. While the heavy particles of undesirable contaminants drop and flow out C and N, the light tufts of lint cotton are vacuumed into chambers D-1 and D-2.

Figure 4A:
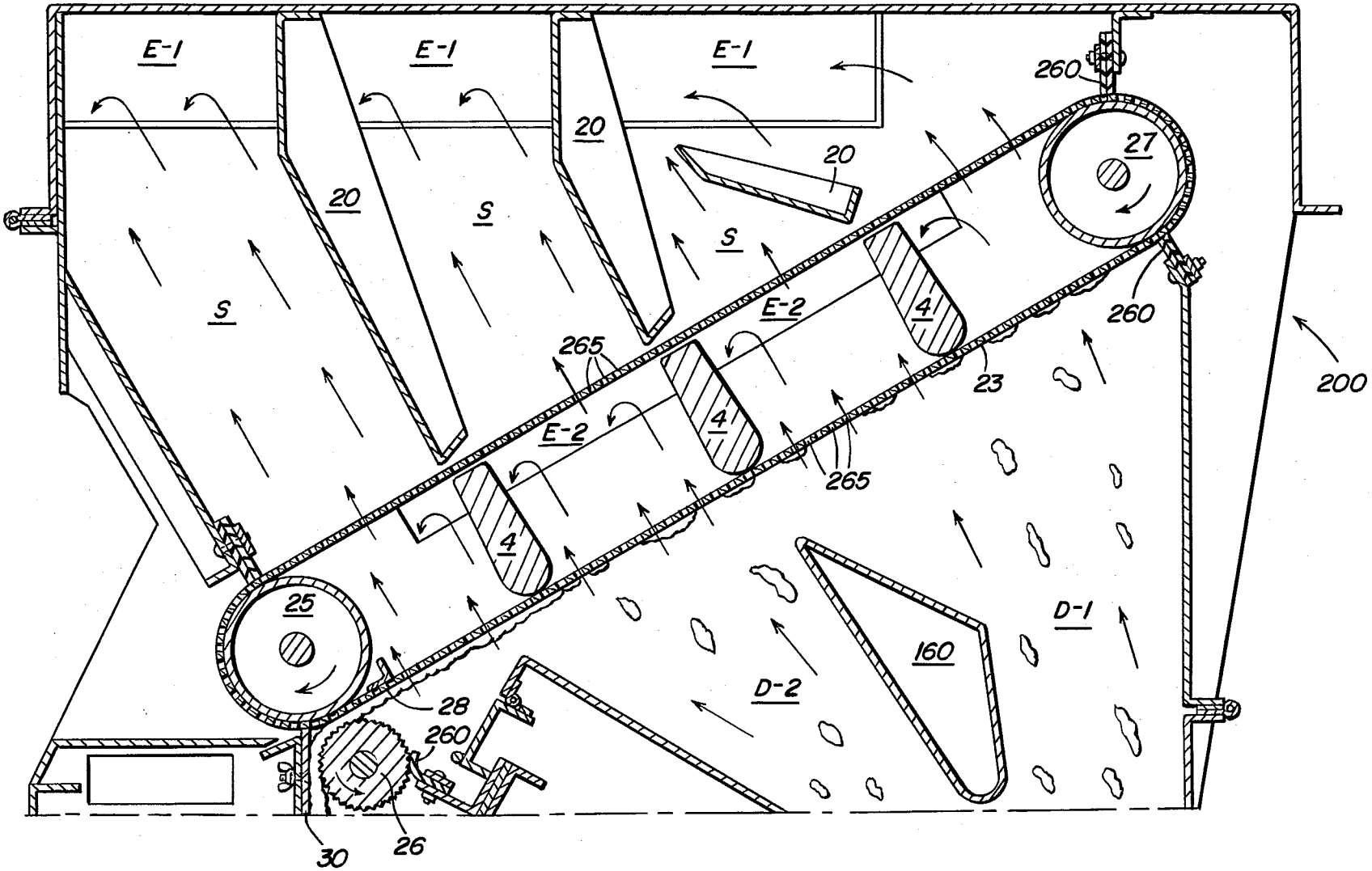
FIG. 4*a* is an enlarged cross-sectional, side view, of the upper portion of the apparatus of FIG. 1.

Just above the ducts D-1 and D-2 is the moving porous screen belt condenser 23. As the air flows through this moving screen 23, cotton accumulates on the belt. The belt is moving in a clockwise direction with an increasing quantity of cotton accumulating thereon as the screen moves toward splined feed roller 26, as best seen in FIGS. 4*a*.

Although the cotton tufts are filtered out of the air stream by the screen belt 23, some short lint fibers and small particles follow the air flow through the screen belt 23 into the top chamber S and through the guide vanes 4 and 20. Air flow is directed outside the condenser chamber by openings E-1 and E-2 to openings F-1, F-2, and F-3 simultaneously, see FIGS. 1 and 3 and the flow lines thereon.

Most of the air flow through the apparatus is ducted to the opening F-1 into a long centrifugal impeller 112. Both ends of the impeller are covered by a cone-shaped filter 116 which rotates as a part of the impeller. The air is filtered as it passes through the cone filter 116, leaving on the filter the small particles that pass through the screen belt 23. This cone filter 116 slings off trash buildup into the lower pressure area duct U, see FIG. 3. In this way, cone filter 116 is constantly self-cleaning. The filtered air passing into the center of the doffing impeller 112 is slung radially outward by the shallow radial blades 212 provided around the long rotating impeller shaft 122. This radiating air doffs or blows the clean lint cotton from the saw cylinder 9 at point V into a diffusing section G and out duct H.

Meanwhile, some air from condenser slots E-1 and E-2 is ducted through F-2 into pipe T. As air flows through pipe T, it accumulates refuse particles from the refuse chamber M dropped by rotational air lock 113. The trash laden air flows from duct T into duct I into pipe J and through refuse blower 114 and out opening L (see FIG. 1).

Air ducted from E-1 and E-2 into slot F-3 flows through the trash chamber M and past the rotating paddle wheel 113. Cylinder 131 is a partial air lock, intended to agitate trash buildups in chamber M and also to regulate air flow through M by adjusting the clearance of scroll W, see FIG. 4*b*. The rotational air lock cylinder 131 together with the rotating paddle wheel 113 may be removed for certain applications. In such a case, the opening F-2 would be sealed and all air flow to blower 114 routed through chamber M, from opening F-3, and from openings E-1 and E-2.

While the air moving through the screen belt 23 is being routed to the suction impellers 112 and 114, the cotton is being conveyed between rollers 25 and 26 as fed by screen belt 23. The bat or blanket 28 of cotton moving between rollers 25 and 26 seals air leakage that would otherwise reduce vacuum in chambers D-1 and D-2. This bat of cotton is pulled downward between plate 30 and roller 26 where it is compressed and then drawn downward between spring loaded feed bar 8 and splined roller 7 where it is compressed again. The bat of compressed cotton is now pulled under the feed bar 8 by the fine-tooth saw cylinder 9 which is rotating at high speed. The cotton fiber is combed (untangled) as it is pulled under the low clearance feed bar 8. The thin cotton bat that is stretched over the rim of the rotating saw 9 is pulled between the saw and grid bars 10 and 11. These grid bars tend to knock away the loosened heavy trash radiating outwardly due to the centrifugal force of the spinning cylinder or saw 9. This trash is slung into chamber M (see FIG. 4*b*) and passes through the revolving rotor 113 into vacuum pipe T, through ducts I and J, into blower 114 and out duct L.

A portion of the air discharged from blower 114 and out duct L is filtered and ducted into a loose fitting cover 210 that encases the drive chains, belts and other drive components of the overall apparatus, see FIG. 11. This current of air flow pressurizes the cover to prevent foreign particles from settling on the drive components.

After the cotton on saw 9 passes through the cleaning chamber M, it is blown from saw 9 into chamber G and out duct H by impeller 112. The clean cotton is then further ducted out extension H' for the next operation. This completes the general operation of the overall apparatus and now the specific components and features thereof will be described individually and in detail.

Figure 4B:
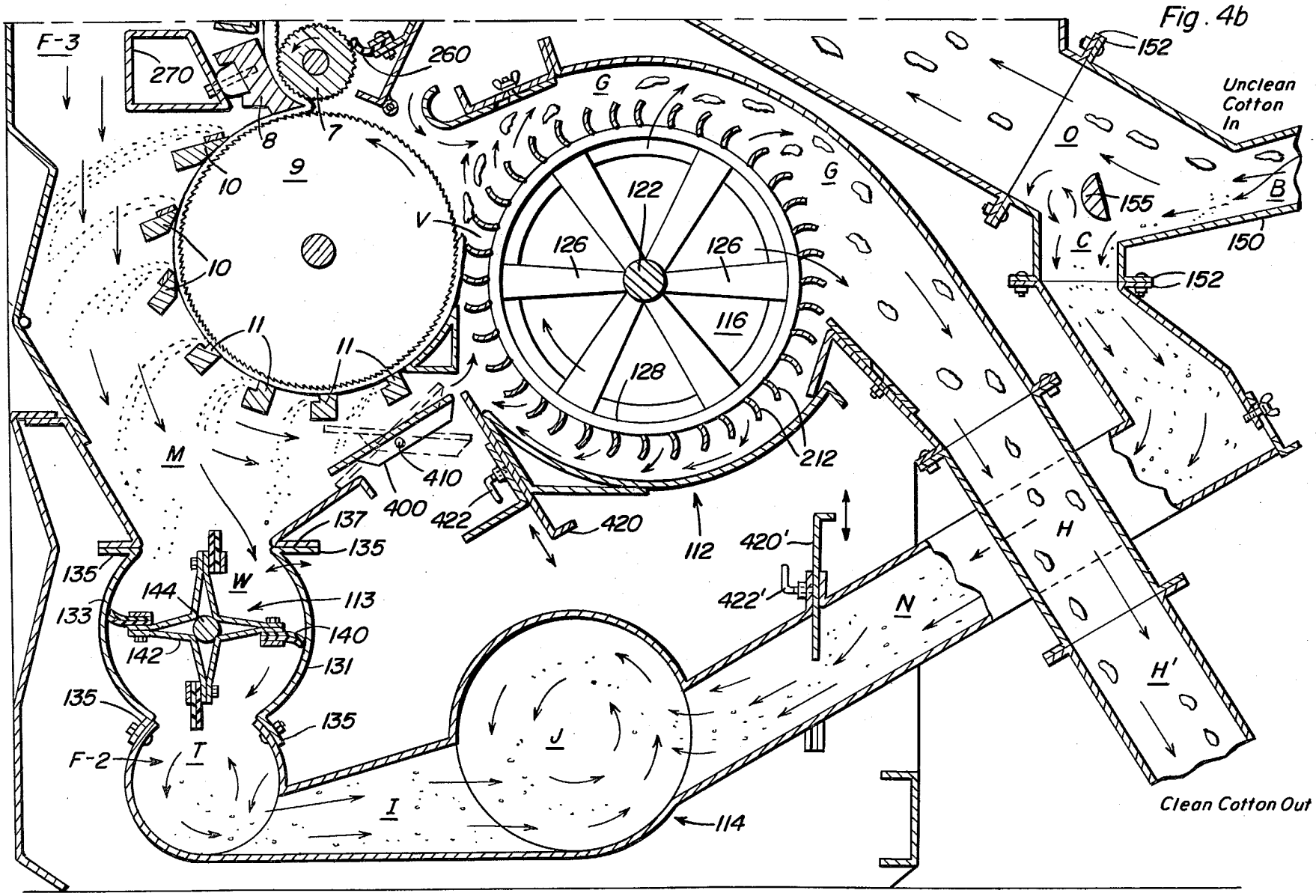
FIG. 4*b* is an enlarged cross-sectional, side view, of the lower portion of the apparatus of FIG. 1.

Looking at FIGS. 1, 4*a* and 4*b*, the input ducting A and B includes appropriate sheet metal duct work of conventional pipe construction 150 having appropriate flanges 152 provided for fastening to the rest of the apparatus by appropriate fastening means such as nuts and bolts shown. The chamber O may have provided therein a splatter board 155 for disrupting the flow path and assuring that the heavy particles of trash will enter the lower hopper portion C while the cotton tufts and balance of air flow will continue upwardly through the chamber O to the chambers D-1 and D-2. As best seen in FIG. 4*a*, a dividing vane 160 is normally provided for dividing the chamber D into D-1 and D-2. This vane 160 for the chamber D may be provided in some installations and omitted in others, such as shown in FIG. 4*a* with it provided, and FIG. 8 being omitted. Appropriate sheet metal work is provided to form said chambers.

The next important component of this apparatus is the condenser belt screen construction. As best seen in FIG. 4*a* and FIG. 8, the condenser has two support rollers 25 and 27, which are appropriately driven by drives, not shown, with a belt 23 rotatably supported on and driven by said rollers. The belt 23 has apertures 265 therein for permitting passage of air flow through said screen belt. Air lock members of flexible material 260 are provided where appropriate to prevent loss of air flow other than as desired through the belt. The input chamber D on one side of the belt supplies the air flow with tufts of cotton therein while the exhaust of said air flow exits out ports E-1 and E-2. Chamber S provides the air from which the exhausts exit and again is formed from sheet metal. The belt 23 itself may be formed of any flexible resilient material which will stand up under such use without substantial wear or failure. While the screen belt condenser finds particular application with the overall apparatus of this invention, it also may be used with other cotton apparatus in and of itself. As seen in FIG. 4*a*, vanes 4 and 20 may be provided to control the air flow through and after leaving the screen belt condenser. Said vanes may be made of any desired material and are mounted to be adjustable so that the amount of air flowing out the exhaust E-1 and E-2 can be changed or diverted through various portions of the chamber.

Figure 14:
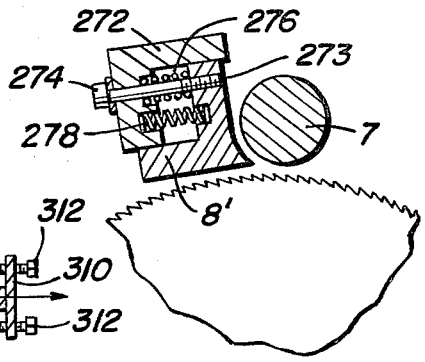
FIG. 14 is an end view, in cross-section, of a spring loaded feed bar as used with the apparatus of this invention.
Figure 10:
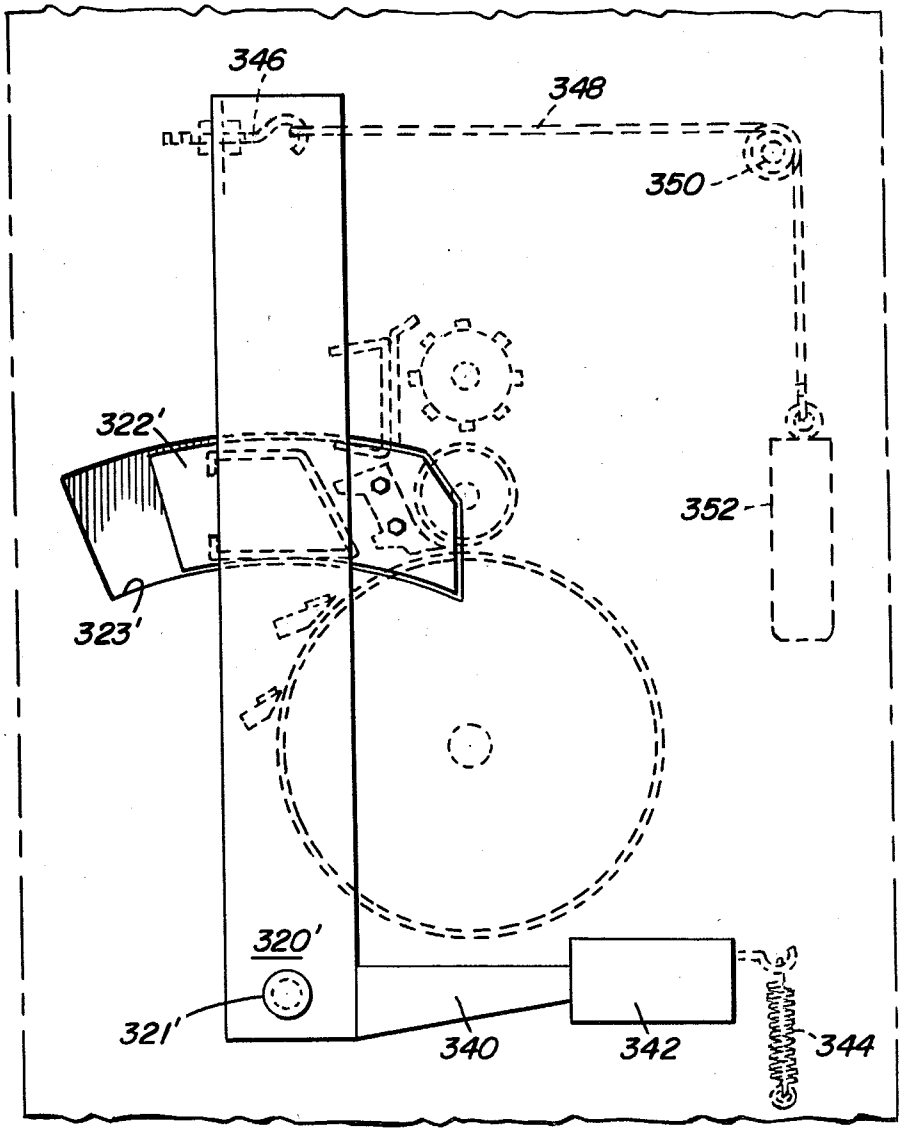
FIG. 10 is a side view of another form of tension mechanism for the floating feed bar of FIG. 9 with a further embodiment of the tension mechanism indicated by dotted lines in said Figure.
Figure 9:
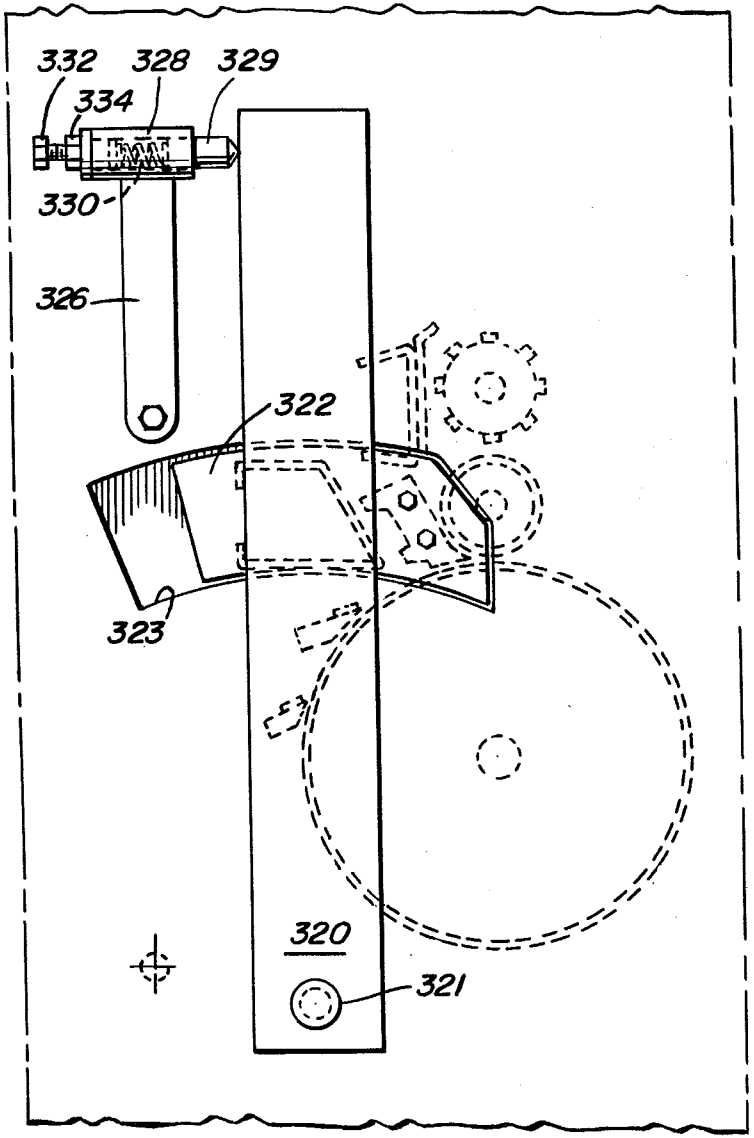
FIG. 9 is a side view of the floating feed bar with one form of tension mechanism as used with the apparatus of this invention.

Part of the air exhausting from exhaust areas E-1 and E-2 reenters the next portion of the apparatus through duct F-3, best seen in FIG. 1. This air will then enter the chamber M for further separation of trash therein. Also, as best seen in FIG. 4*b*, the feed roller 7 has a feed bar 8 arranged for close association therewith which is appropriately supported from a member 270 between the frame of the overall apparatus. The feed bar 8 may be of a fixed type or may be of the type shown in FIG. 9 and 10, that is, pivotably mounted, or a spring biased type as shown in FIG. 14. The type pivotably mounted as shown in FIGS. 9 and 10 will be described next. A pivot lever member 320 is pivotally mounted about a pin 321 appropriately supported by the side of the apparatus. While only one pivot arm 320 is shown on the left side of the machine, a duplicate or mirror image of same will also be provided on the right side of said apparatus. The two levers support arcuate plates 322, within recesses 323, with plates 322 supporting the feed bar at each end and therebetween.

As shown in FIG. 9, the tension applying means for the feed bar through the pivotable levers 320 is by means of the arm 326 having a tubular member 328 mounted thereon. The tubular member 328 has a pin 329 which is spring biased by means of spring 330, and with the pressure being adjustable by bolt 332, and lock nut 334 thereon. By screwing the bolt inwardly into the tubular member 328, the amount of spring pressure will obviously be increased to provide increased pressure through the pivot lever to the feed bar per se. Several modifications and embodiments of this tension adjusting means are shown in FIG. 10. The pivot arm 320', pivot pin 321', and arcuate segment 322' in recess 323' all correspond to the structure described above. Again, a mirror image of the disclosed structure is provided on the opposite side of the apparatus with the feed bar appropriately mounted therebetween. The tension producing structure in FIG. 10 consists of the extension arm 340 fastened to the pivot arm 320' and having an adjustable weight 342 mounted thereon. Thus, by gravity action, the amount of pressure and biasing of the feed bar against the feed rollers is provided. If desired, an extra adjusting spring 344 may also be used with this embodiment. In the upper portion of FIG. 10 and as indicated by dotted lines, another further embodiment of the pressure producing structure is shown. This consists of a hook member 346 appropriately fastened to the upper end of the pivot arm 320' and connected by a cable 348 over pulley 350 to a weight 352. Again, by gravity action appropriate biasing pressure will be applied through the pivotal lever to the feed bar.

FIG. 14 shows another embodiment wherein the feed bar 8' is spring biased internally thereof instead of being mounted on the pivotal levers as seen in FIGS. 9 and 10. In the embodiment of FIG. 14, the main support member 272 is provided, and a threaded aperture 273 in the feed bar 8' receives a bolt 274 having a small centering spring 276 thereabout. A primary spring 278 is provided between the support member 272 and the feed bar 8' for urging and spring pressuring the feed bar 8' towards and close to the feed roller 7.

Looking at FIG. 4*b*, the saw cylinder 9 with the grid bars 10 and 11 may best be seen. The saw cylinder 9 will collect cotton being fed by feed roller 7 in a well known manner for combing and fluffing thereof by the grid bars 10 and 11. Thus, as envisioned by this invention, the grid bars 10 and 11 may be modified from conventional type grid bars. Looking at FIG. 5, the grid bar 10 is provided with a metal strip 40 appropriately fastened by recessed screws 42 to the main body of the grid bar. The grid bar has a sloped face 44 which together with the plate 40 will provide a double edge as indicated by reference numeral 45 in FIG. 5. By forming the grid bar as seen in FIG. 5, two fiber engaging edges are provided instead of a single edge. The function thereof is to provide two cleaning edges per each grid bar in order to have the fiber make two small bends instead of one severe bend. The result of this is that the overall damage to the fibers is greatly lessened due to the kinking and cutting caused by the sharp bending of the fibers around a single grid edge. This is another important feature of this invention and while quite simple in detail does result in tremendous benefits. FIG. 6 shows another manner of forming a double edge grid bar wherein the grid bar structure 11 has a recess 47 cut or machined in the leading edge thereof to produce two pointed edges for the same purpose as described above.

Figure 12:
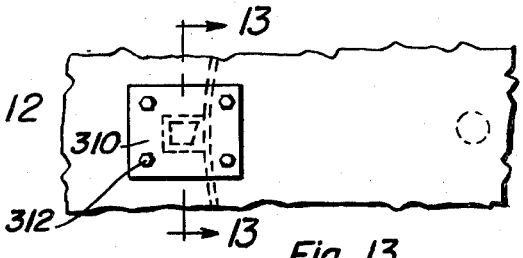
FIG. 12 is an end view of the grid bar tension system as used with the apparatus of this invention.
Figure 13:
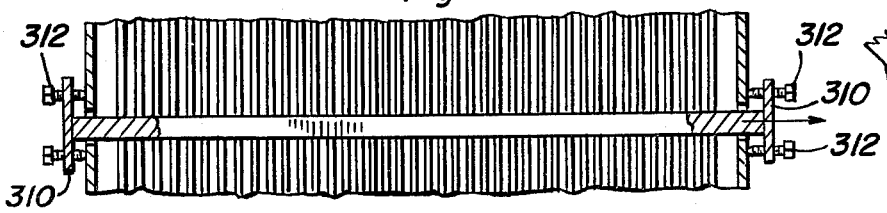
FIG. 13 is a side view taken generally along lines 13—13 of FIG. 12.

The support of the grid bars shown between the sides of the apparatus is also quite important. In conventional cotton machines having saw cylinders and grid bars, the bars normally are supported in the apparatus by pressure on the ends thereof. It has been discovered by the applicant, that if the grid bars are supported under tension rather than pressure, a very desirable result is obtained. FIGS. 12 and 13 show this embodiment. These Figures show the grid bars, either 10 or 11, being connected between plates 310 and appropriately fastened to said plates by welding or other means. Adjusting screws 312 at the corners of the plates 310 provide quick and easy mechanical structure for increasing or decreasing the tension on said grid bars. Appropriate apertures are provided in the side walls of the main support frame for passage of the ends of the grid bars therethrough prior to connection with said plates.

Looking at FIG. 4*b* an adjustable vane plate 400 mounted upon pins 410 is shown. This adjustable plate permits a portion of the flow of air and suspended cotton to bypass the saw cylinder and supporting guides therefor. With the adjustable guide 400 being entirely closed, all of the cotton will be conveyed by means of the saw cylinder 9 through the grid bars to point V of the doffing structure.

The doffing structure, as best seen in FIGS. 4*b* and 7, is another important component of this apparatus. The centrifugal force doffing cylinder has a main rotatable support shaft 122 with a plurality of arms 126 fastened thereto for supporting rims 128. Upon the cylindrical rims 128 are mounted a plurality of curved vanes 212 for completing the doffing impeller. Obviously, under high speed rotation, air will be inducted through the center ends of this doffer and expelled through the curved vanes outwardly as directed by the curved sheet metal guiding structure to produce an outward flow concentrated at point V in FIG. 4*b*. This will result in doffing the cotton from the saw cylinder 9 in an upward circular path, as indicated by the flow lines on FIG. 4*b*, and into the duct G. Flow then will continue from G through duct H and H' with the clean cotton being exhausted to a common collection or usage point. The curved blades or vanes 212 are shown as being fastened to the rims 128, but obviously this invention envisions making said vanes of an adjustable nature. Also, the vanes may be of straight configuration rather than curved for other applications of the device.

Looking again at FIG. 4*b*, an adjustable shutoff valve 420 is appropriately provided in the main support structure which may be locked in a fixed position by means of fastening device 422. This will also give additional flexibility as to adjustment of the flow paths through the overall apparatus. Another similar adjusting valve 420' and locking means 422' are shown in the duct work N which feeds to the blower/impeller J, 114.

The blower and impeller 114 of conventional construction is used to discharge the trash which accumulates in the chamber C and the duct work N. Also, this blower/impeller 114 will suck trash through duct I, chamber T, F-2 and the vacuum lock 113, 131. The vacuum lock 113, 131 as best seen in FIG. 4*b* consists of the cylindrically formed sheet metal portions 131, 133 having at the upper and lower ends thereof flanges 135 which flanges are appropriately fastened by bolts or other means to the rest of the associated duct work and sheet metal work of the overall apparatus. As indicated by the double arrow at the upper portion of the member 131 in FIG. 4*b*, this side or if desired both sides of the cylindrical container may be adjusted sidewise to increase the engagement of the inner portion of said cylinder with the tips of the rotating lock 113. These tips 140 are mounted upon support arms 142 radiating from the center drive rod 144. When the drive rod 144 is appropriately driven by means not shown, it will tend to pass trash from the bottom portion of the hopper M on through to duct F-2 and T for eventual passage through duct I and discharge through J, blower 114 and the discharge path. As mentioned above, the vacuum lock structure 113, 131 may be eliminated in some modifications of the overall apparatus.

Figure 2:
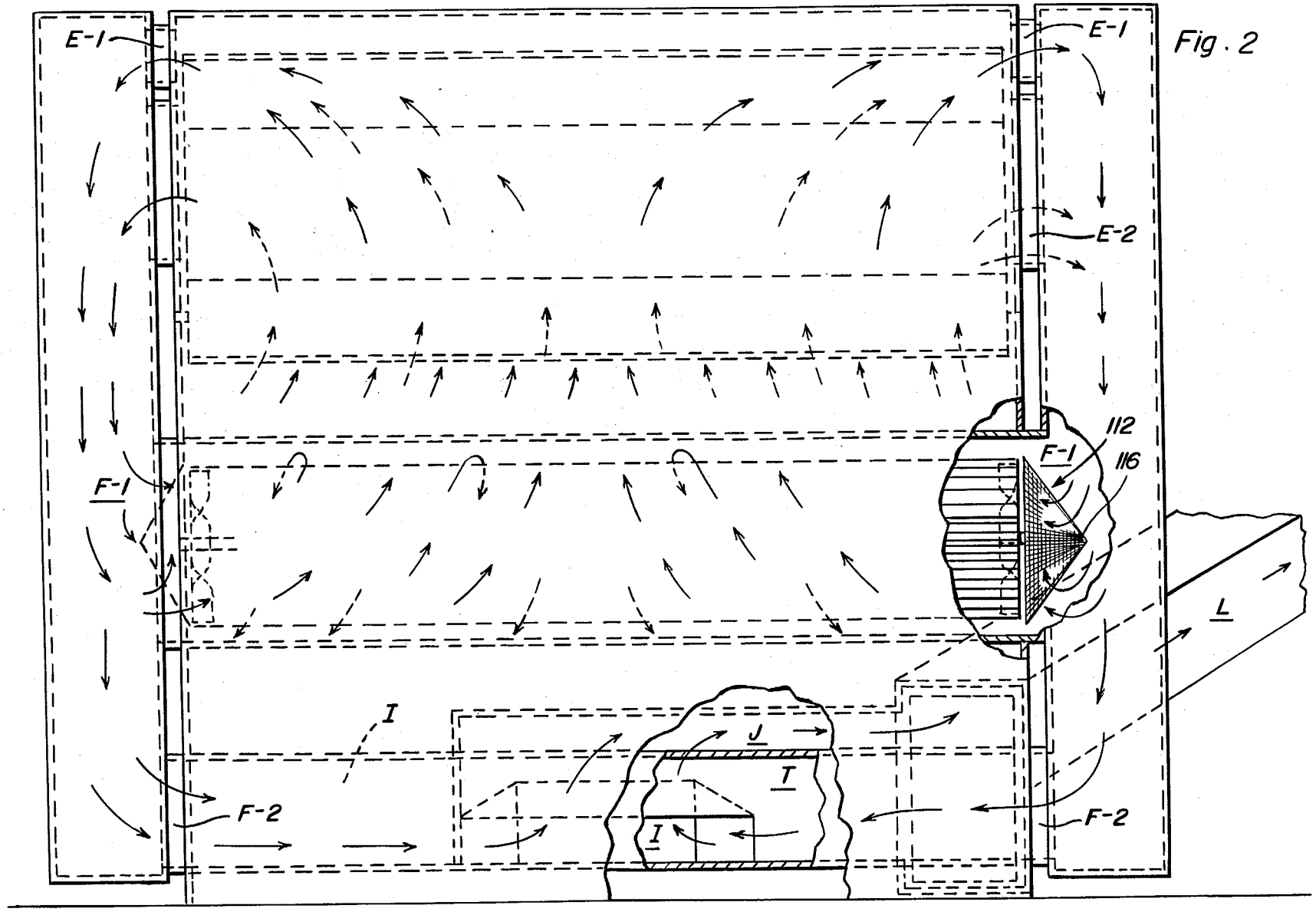
FIG. 2 is an end view, partly in cross-section, of the flow paths of air through the apparatus of this invention.

FIG. 2 shows the various flow paths of the air and cotton tufts throughout the overall machine as viewed from one end thereof.

Another important feature of this lint cleaning apparatus is in the arrangement for the drive components of said apparatus. The output blower 114 and exhaust duct L, as best seen in FIG. 11, is suitably tapped by ducting 200 having a suitable filter contained therein for preventing any of the trash from being fed into said cover. The cover 210 is shown as having open portions at the bottom and top thereof, but may have openings anywhere along the circumference just as long as the inside of said cover which is over the drive components, as shown in broken perspective in FIG. 11, has pressure flow therein in order to maintain said drive components under a degree of pressure. This pressure will prevent any contamination from settling upon the drive components per se. This is very important from the standpoint of overall life and less maintenance of the overall components.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

What is claimed as new is as follows:

1. In a cotton lint cleaner comprising a chamber having inlet means for a mixture of air and cotton to be cleaned with the inlet means defining a flow path, means providing a pressure differential in the flow path to cause movement of the air and cotton mixture along the flow path, that improvement comprising a condenser in the form of a porous endless belt disposed transversely of the flow path whereby cotton will be deposited on the belt and air will pass therethrough, means movably supporting said belt for moving the cotton deposited on the belt outwardly of the flow path for removal from the belt, said means movably supporting said belt including a pair of parallel end rollers over which the belt is entrained to provide the belt with spaced parallel portions with cotton being deposited on the portion of the belt disposed upstream of the flow path, air outlet means disposed between the parallel portion of the belt and forming a portion of the flow path and air outlet means disposed in spaced relation to the portion of the belt disposed downstream of the flow path, whereby a portion of the air passing through the upstream portion of the belt passes outwardly through each of the air outlet means.

2. In a cotton lint cleaner comprising a chamber having inlet means for a mixture of air and cotton to be cleaned with the inlet means defining a flow path, means providing a pressure differential in the flow path to cause movement of the air and cotton mixture along the flow path, that improvement comprising a condenser in the form of a porous endless belt disposed transversely of the flow path whereby cotton will be deposited on the belt and air will pass therethrough, means movably supporting said belt for moving the cotton deposited on the belt outwardly of the flow path for removal from the belt, said means movably supporting said belt including a pair of parallel end rollers over which the belt is entrained to provide the belt with spaced parallel portions with cotton being deposited on the portion of the belt disposed upstream of the flow path, air outlet means disposed between the parallel portion of the belt and forming a portion of the flow path and air outlet means disposed in spaced relation to the portion of the belt disposed in spaced relation to the portion of the belt disposed downstream of the flow path, and air flow guide vanes disposed in spaced relation between the parallel portions of the belt, air flow guide vanes disposed in spaced relation to each other and extending outwardly of the portion of the belt disposed downstream of the flow path, and flexible air lock members disposed in adjacent relation to portions of the belt to assure air flow through the belt.

3. The structure as defined in claim 2 wherein said air flow guide vanes extending outwardly of the belt extend to the air outlet means spaced from the belt to divide the flow path on the downstream side of the belt into separate flow paths for discharge of air passing through the belt to different areas of a lint cleaner.

4. The structure as defined in claim 1 wherein said air flow guide vanes between the parallel portions of the belt are substantially parallel and extend substantially completely across the space between the parallel portions of the belt, said air outlet means disposed between the parallel portions of the belt being an elongated narrow opening disposed adjacent the portion of the belt disposed downstream of the flow path.

* * * * *